US008393826B1

(12) United States Patent
Marsolek et al.

(10) Patent No.: US 8,393,826 B1
(45) Date of Patent: Mar. 12, 2013

(54) APPARATUS FOR TRANSFERRING LINEAR LOADS

(75) Inventors: John L. Marsolek, Watertown, MN (US); Nicholas A. Oetken, Brooklyn Park, MN (US); Nathan L. Mashek, Saint Michael, MN (US); Eric A. Hansen, Big Lake, MN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/222,571

(22) Filed: Aug. 31, 2011

(51) Int. Cl.
*E01C 19/38* (2006.01)

(52) U.S. Cl. ..... 404/117; 404/122; 74/61

(58) Field of Classification Search ..... 404/113, 404/117–128, 133.05–133.2; 74/25, 61, 74/62

See application file for complete search history.

(56) References Cited

U.S. PATENT DOCUMENTS

| | | | | | |
|---|---|---|---|---|---|
| 1,398,843 | A | * | 11/1921 | Cullen | 72/250 |
| 2,410,170 | A | | 11/1943 | Lazan | |
| 2,930,244 | A | | 3/1960 | Hutchinson et al. | |
| 3,814,532 | A | * | 6/1974 | Barrett et al. | 404/117 |
| 3,909,147 | A | | 9/1975 | Takata | |
| 4,108,009 | A | | 8/1978 | Fuchigami | |
| 4,350,460 | A | | 9/1982 | Schmelzer et al. | |
| 4,481,835 | A | | 11/1984 | Storm | |
| 4,561,319 | A | | 12/1985 | Lilja | |
| 4,568,218 | A | | 2/1986 | Orzal | |
| 4,586,847 | A | * | 5/1986 | Stanton | 404/117 |
| 7,270,025 | B2 | | 9/2007 | Niglöv | |
| 2010/0147090 | A1 | | 6/2010 | Kuerten | |
| 2011/0158745 | A1 | | 6/2011 | Oetken et al. | |

FOREIGN PATENT DOCUMENTS

| | | |
|---|---|---|
| GB | 2159236 | 11/1985 |

* cited by examiner

*Primary Examiner* — Raymond W Addie
(74) *Attorney, Agent, or Firm* — Miller, Matthias & Hull

(57) ABSTRACT

Apparatus for transferring a linear load through a high-speed rotating member includes a linear actuator containing an axially translatable cylinder rod. A mounting adapter fixed against axial and rotary movement is rigidly affixed to an actuator cylinder containing the cylinder rod. An elongate guide sleeve, fixed to the mounting adapter, extends axially from the adapter to accommodate an axially translatable thrust bearing affixed to one end of the cylinder rod. The guide sleeve contains a linear slot for accommodating a guide pin affixed to the thrust bearing housing, and transversely movable within the linear slot to prevent rotation of both bearing housing and cylinder rod components.

20 Claims, 6 Drawing Sheets

APPARATUS FOR TRANSFERRING LINEAR LOADS

RELATED U.S. APPLICATION DATA

This application is related to U.S. application Ser. No. 12/962,758 entitled Vibratory System for a Compactor, filed Dec. 8, 2010.

TECHNICAL FIELD OF THE DISCLOSURE

The present disclosure relates to linear actuators adapted for transferring linear loads through high speed rotating members. More particularly, the disclosure relates to an apparatus for preventing undesirable rotation of an actuator cylinder rod in a compactor machine.

BACKGROUND OF THE DISCLOSURE

Compactor machines, also variously called compaction machines, are frequently employed for compacting fresh laid asphalt, dirt, gravel, and other compactable materials associated with road surfaces. One such type of compaction machine is a drum-type compactor having one or more drums adapted to compact particular material over which the compactor is being driven. In order to compact the material, the drum-type compactor includes a drum assembly having a vibratory mechanism that includes inner and outer eccentric weights arranged on a rotatable shaft situated within a cavity of the inner eccentric weight. Both amplitude and frequency of vibration are typically controlled to establish degree of compaction. Amplitude is often controlled by a transversely moveable linear actuator adapted to axially bear against an axially translatable key shaft, causing the key shaft to rotate. The rotation of the key shaft in turn alters relative positions of the inner and the outer eccentric weights to vary amplitude of vibration created within the drum. Frequency of vibration is controlled by changing speed of a drive motor positioned within the compactor drum.

To change relative positioning of the inner and the outer eccentric weights, the rotatable shaft typically engages the weights through variously shaped outer surfaces of the shaft. By way of example, U.S. Pat. No. 4,350,460 discloses that the outer surface of a key shaft may be provided with one distinctly shaped, i.e. polygonal, cross-section adapted to engage the inner eccentric weight and another distinctly shaped cross-section to engage the outer eccentric weight for positioning the eccentric weights relative to one another. Those skilled in the art will appreciate that the eccentric weights are normally adapted to rotate together at speeds that approach and/or exceed 4000 revolutions per minute. To assure degree of vibration sufficient to achieve desirable compaction results, some materials require higher frequency vibrations than others. Unfortunately, such vibrations of heavy-duty structures can result in undesirable movements of some parts of such machines relative to adjacent parts. In particular, cylinder rods that may be utilized to rotate the eccentric weights relative to one another may have a tendency to rotate within their associated fixed cylinders, resulting in undesirable wear.

Accordingly, it would be beneficial to provide a system that minimizes wear of actuators and such associated parts. By preventing and/or avoiding premature wear, such system could among other virtues promote reduced frequency of part replacements.

SUMMARY OF THE DISCLOSURE

In accordance with one aspect of the present disclosure, an apparatus for transferring a linear load through a high-speed rotating member for use in a compactor machine is disclosed. The apparatus may include a linear actuator including an actuator cylinder adapted to accommodate an axially translatable cylinder rod. A thrust bearing may be affixed to one end of the cylinder rod, and a helically splined key shaft may be affixed to the inner race of the thrust bearing for rotation and axial movement of the rod, bearing, and key shaft components. The actuator cylinder may be rigidly affixed to a fixed mounting adapter, and an elongate sleeve may also be affixed to and extend from the adapter to assure against any axial or rotary movement of the sleeve. The sleeve may incorporate an axially oriented elongate slot, and a guide pin may extend radially through the slot and be affixed to the axially translatable housing of the thrust bearing. The guide pin may be constrained by the slot against rotary movement to prevent rotation of both the bearing housing and the cylinder rod as the rod moves the key shaft linearly between retracted and extended positions.

In accordance with another aspect of the present disclosure, the apparatus may be utilized within a compactor machine to move a pair of eccentric weights concentrically positioned relative to one another between minimum and maximum vibration amplitude positions. For this purpose, the key shaft of the apparatus may incorporate a helical spline at one end and an axial or straight spline at its opposite end. The axial spline may be adapted to slide within one of the eccentric weights whenever the key shaft is axially moved between retracted and extended positions of the actuator cylinder rod.

In accordance with another aspect of the present disclosure, a compaction machine may include a vibratory mechanism having a) a key shaft with a helical spline at one end and an axial or straight spline at its opposite end; and b) an outer eccentric weight having a helical bore and an inner eccentric weight having an axial bore with the key shaft positioned with its axial spline end positioned within and engaged with the axial bore of the inner eccentric weight for linear relative motion therein, and its opposite helical end engaged with the helical bore of the outer eccentric weight to urge rotation of the inner eccentric weight relative to the outer eccentric weight whenever the key shaft is moved between retracted and extended positions by the actuator cylinder rod. The vibratory mechanism may further include a vibratory motor adapted to directly rotate the outer eccentric weight, and to thereby indirectly rotate the inner eccentric weight at the same rotational speed.

DETAILED DESCRIPTION OF THE DISCLOSURE

Figure 1:
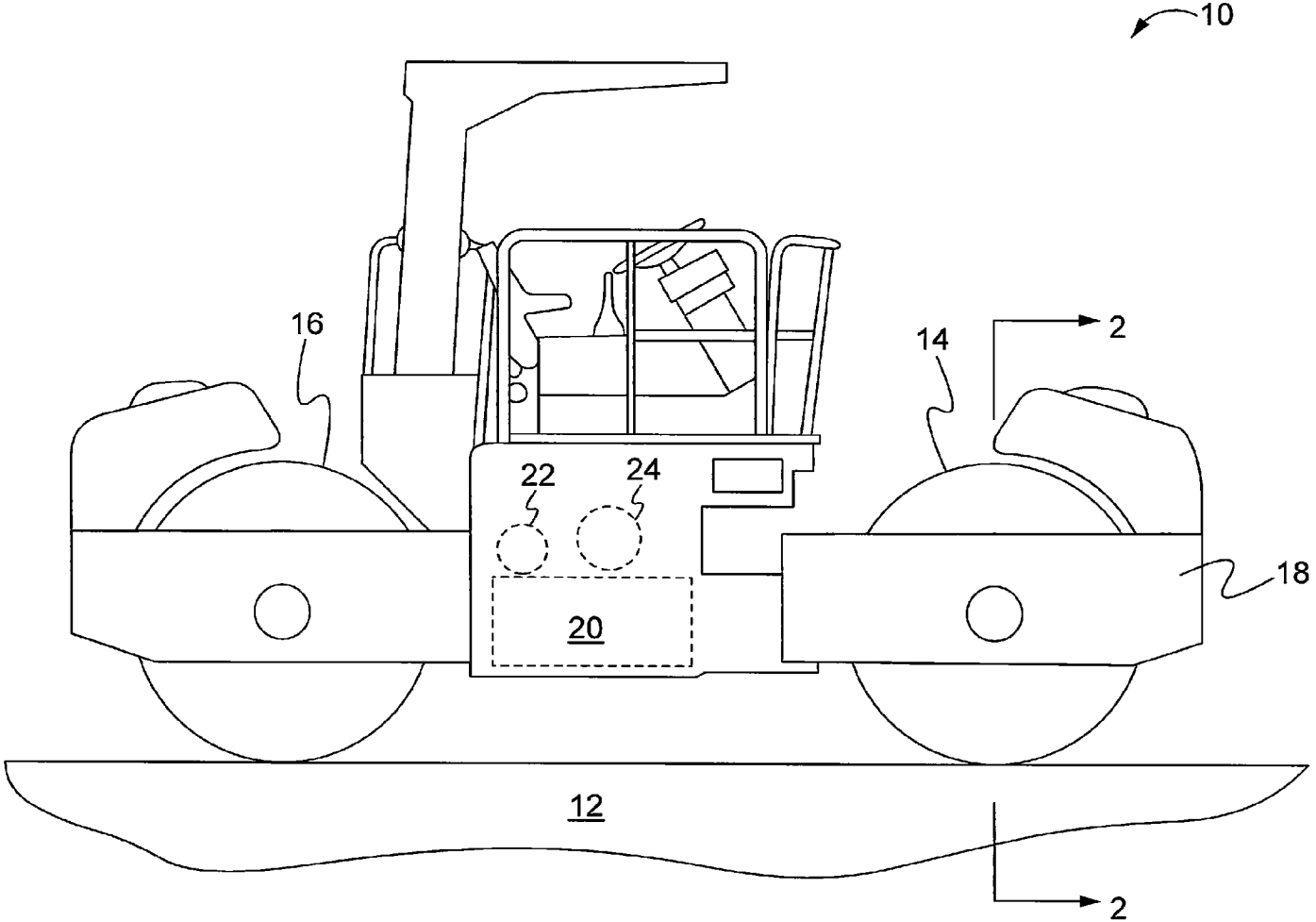
FIG. 1 is a schematic side elevation of a compaction machine that embodies elements of the present disclosure.

Making initial reference to FIG. 1, a double vibratory drum compaction machine 10 may be useful for compacting and/or increasing density of a compactable material or mat 12, such as soil, gravel, and/or bituminous mixtures. The machine 10 may have a front compacting drum 14 and a rear compacting drum 16, both rotatably mounted on a main frame 18. Although displayed herein as a double drum machine, the compactor 10 may alternatively utilize only a single vibratory drum without departing from the spirit and scope of the present disclosure. In the single vibratory drum machine, conventional wheels would be employed in lieu of the second drum for accommodating appropriate mobility of the machine 10.

The main frame 18 may also support an engine 20 (shown in phantom) for supplying motive power to the machine 10, as well as operating power to at least one electric generator 22 or fluid pump such as a variable displacement fluid pump 24 (both shown in phantom). To the extent that the front drum 14 and the rear drum 16 may be structurally and operatively equivalent, the description of all components related thereto will be described only with respect to the front drum 14. As such, all aspects of the disclosure related to drum 14 apply with equal force to the rear drum 16.

Figure 2:
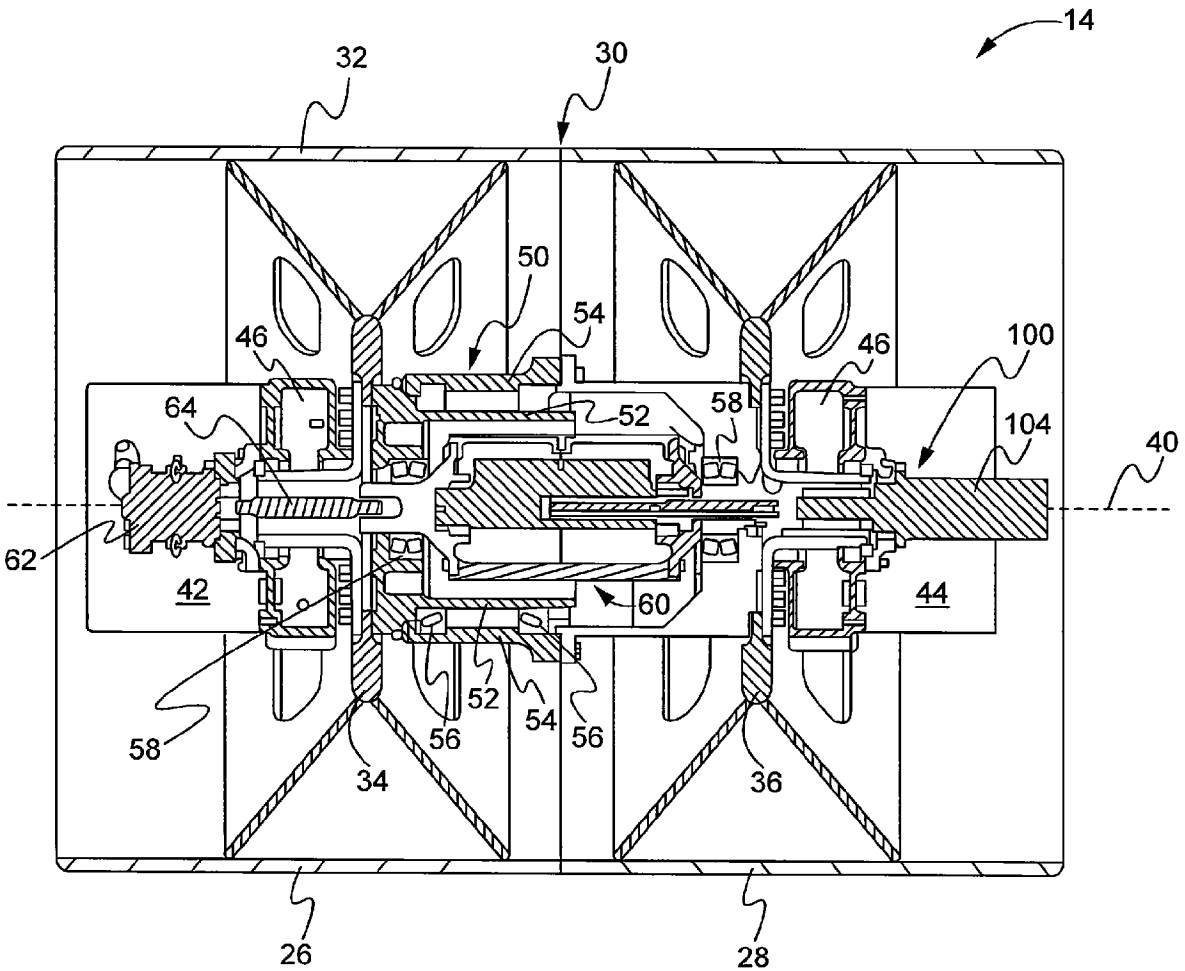
FIG. 2 is an axial cross-sectional view, taken along lines 2-2 of FIG. 1, depicting the interior of a compacting drum that includes a vibratory mechanism incorporated within the compaction machine of FIG. 1.

Referring now to FIG. 2, the front drum 14 may include first and second drum sections; i.e., left section 26 and right section 28, as shown, the two sections being separated by a split 30 to define the double drum configuration. The double drum permits a speed differential between the drums during the turning of the machine 10 about a radius. As those skilled in the art will appreciate, the drum closest to the turn radius will typically rotate at a slower rotational speed than the outside drum. Such differential action reduces the tendency for scuffing, tearing, or otherwise damaging the surface being compacted. Each of the first and second drum sections 26, 28 may be fabricated of an outer shell 32, and have first and second bulkheads 34 and 36 fixedly secured to inside diameters of respective sections 26, 28 that form each outer shell 32.

First and second propel motors 42, 44 are positioned between the main frame 18 and first and second drum sections 26, 28, respectively. The propel motors 42, 44 may each be connected to a mounting plate (not shown) secured to the main frame 18. The output of the first and second propel motors 42, 44 may drive the first and second bulkheads 34 and 36, respectively, through a pair of offset gearboxes 46, which may allow the propel motors 42 and 44 to be positioned slightly offset from the drum axis 40. Alternatively, in a different mounting configuration the first and second propel motors 42, 44 may be directly connected to bulkheads 34, 36, eliminating the offset gearboxes 46. Finally, the propel motors 42, 44 may be operatively connected to the above noted power sources 22, 24, which may supply pressurized fluid and/or electric current to operate the motors for rotating the drum sections 26, 28.

A support arrangement 50 rotatably connects the first drum section 26 to the second drum section 28, while also housing a vibratory mechanism 60. The support arrangement 50 is rotatably connected to first and second bulkheads 34, 36 to enable the respective drum sections 26, 28 to rotate relative to one another in accordance with the differential aspect described above. In addition, the support arrangement 50 may include first and second support members 52 and 54, wherein first member 52 is rotatably positioned inside of the second member 54 for movement relative thereto by way of a first set of bearings 56, as shown. The support arrangement 50, which shares its centerline with drum axis 40, will accommodate the earlier-described differential rotational movements between the first drum section 26 via the first propel motor 42 and the second drum section 28 via the second propel motor 44.

Figure 3:
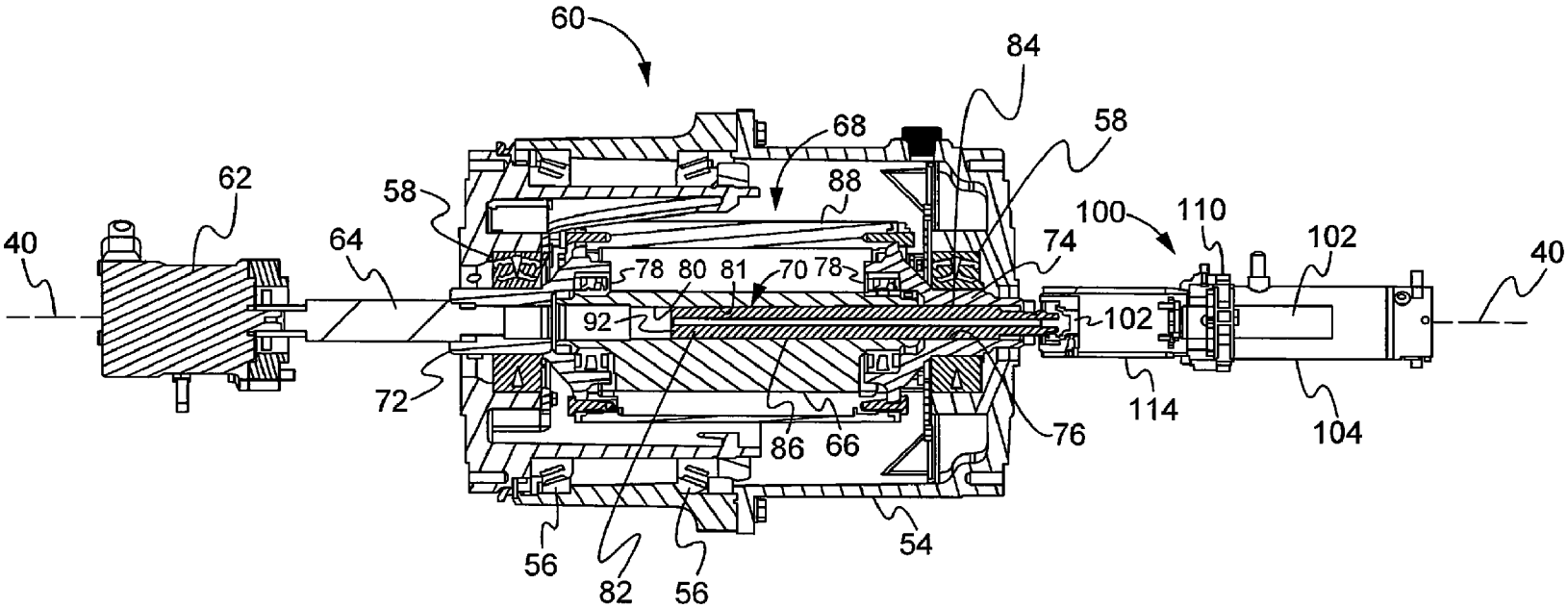
FIG. 3 is an axial cross-sectional view of the vibratory mechanism of FIG. 2, illustrating a key shaft and the disclosed linear actuator components adapted to axially translate the key shaft.

In reference now to FIG. 3, the vibratory mechanism 60 is rotatably supported about the drum axis 40 by way of a second bearing arrangement, or second set of bearings 58. The vibratory mechanism 60 may be driven by a driveshaft 64 through means of a vibratory motor 62. The mechanism 60 may include a pair of inner and outer concentrically positioned eccentric weights, 66 and 68, respectively. A key shaft 70 may be adapted to engage both weights 66, 68, via a linear actuator 100 adapted to move the key shaft 70 in a manner described hereinbelow.

The outer eccentric weight 68 may be a driven or vibratory motor-side stub shaft 72 affixed to the driveshaft 64, and a linear actuator-side stub shaft 74. The stub shafts 72, 74 are positioned within the inner races of the second set of bearings 58 as shown. It will be apparent that the driveshaft 64 may be attached to the driven side stub shaft 72 by way of a splined connection as depicted, although other fastening mechanisms may be employed instead. The actuator side stub shaft 74 includes a helical bore 76 for a purpose described below.

While the above-described collective parts of the eccentric weight 68 may constitute a hollow semi-cylindrical or lobed casting carrying more weight on one radial side than the other, the inner eccentric 66 may be a solid, albeit lopsided, mass positioned within the hollowed portion of the outer eccentric weight 68. For accommodating rotary relative movement between the inner and outer eccentric weights 66, 68, the inner weight 66 may be supported within the weight 68 by a third bearing arrangement, or third set of bearings 78, situated radially within the left and right stub shafts 72 and 74, as depicted.

Extending axially inwardly from the linear actuator end of the inner eccentric weight 66 is a bore 80 formed with axially extending female splined portion 81 for accommodating the driven or left end 92 of the key shaft 70. Commensurately, the driven end of the key shaft 70 may be formed with male splines defining an axially splined portion 82 adapted to complementarily engage the splined portion 81 of the bore 80. In contrast, the actuator end or right end of the key shaft 70 may contain a helically splined portion 84 adapted to engage the helical bore 76 of the actuator-side stub shaft 74.

The key shaft 70 may also define a smooth intermediate portion 86 situated between the axially splined portion 82 and the helically splined portion 84 on its respective left and right ends. The axially splined portion 82 may engage the bore 80 in a manner ensuring that the inner eccentric weight 66 and the key shaft 70 may be rotatably fixed relative to each other while permitting the key shaft to slide axially within the bore 80. Conversely, the helically splined portion 84 of the key shaft 70 may be adapted to engage the helically splined bore 76 of the stub shaft 74 to transfer axial movement of the key shaft 70 into rotational movement of both the key shaft 70 and the inner eccentric weight 66 relative to the outer eccentric weight 68, to provide up to 180 degrees of relative rotary movement between the weight 66 and the weight 68.

As also apparent in FIG. 3, the linear actuator 100 incorporates an axially extending cylinder rod 102 that may be adapted to engage the key shaft 70 for axially translatable movement therewith. The cylinder rod 102 extends from an actuator cylinder 104 that accommodates extension and retraction of the cylinder rod 102, to in turn extend and retract the key shaft 70 linearly along the axis 40.

Figure 4:
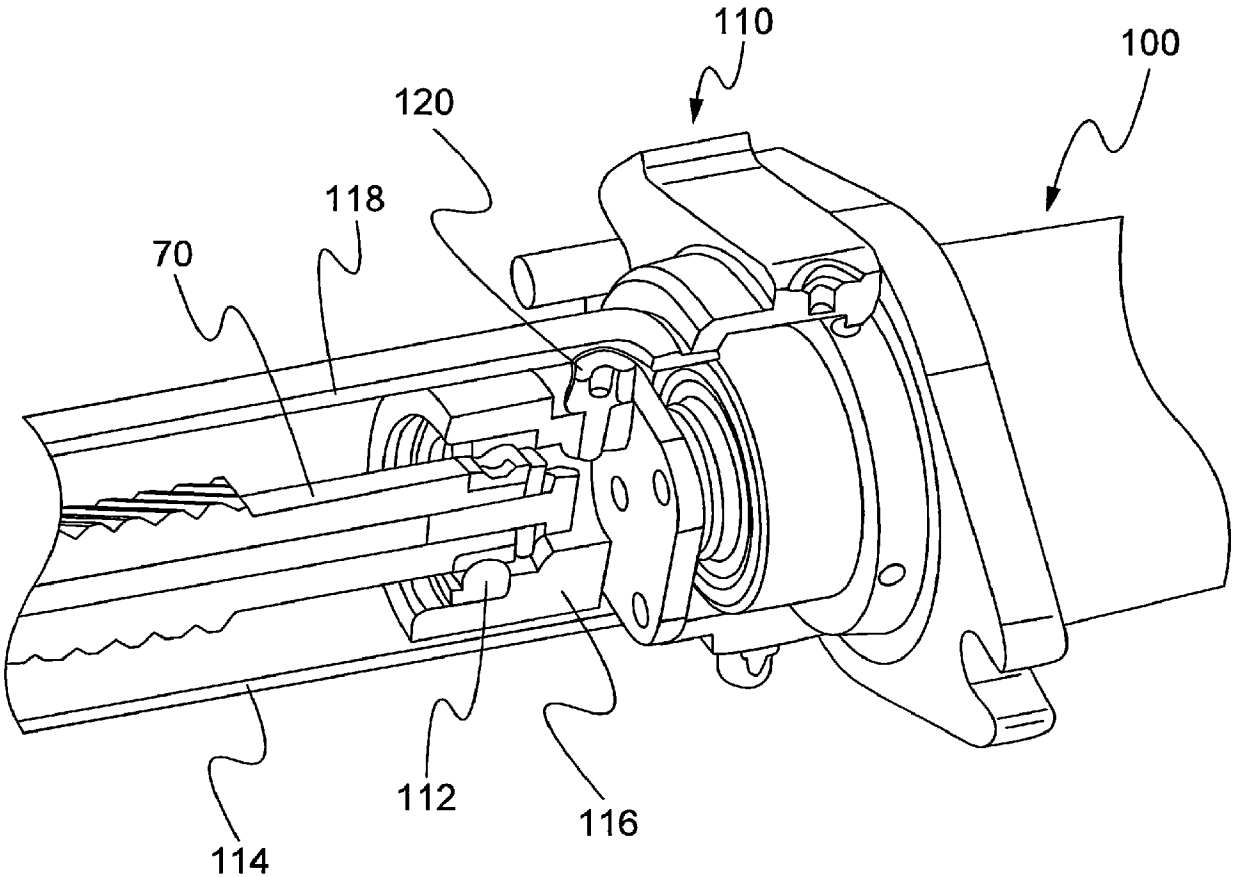
FIG. 4 is a perspective view of the linear actuator components, including interactions of key shaft with thrust bearing and guide sleeve in greater detail.

Referring now also to FIG. 4, interposed between otherwise abutting ends of the cylinder rod 102 and the helically splined portion 84 of the key shaft 70 may be a thrust bearing 112 having a housing 116 secured to an adapter 110, which may in turn be bolted to the offset gearbox 46. To the housing 116 is secured the outer race of the thrust bearing 112. The end of the helically splined portion 84 of the key shaft is secured to the rotatably movable inner race of the thrust bearing 112. As such, when the cylinder rod 102 is being urged leftwardly, either manually by an operator or automatically via computerized programming, the key shaft 70 is forced leftwardly, and thus forced to rotate by interaction of its helically splined portion 84 within the helical bore 76 (FIG. 3), as the stub shaft 74 containing the bore is fixed against rotation. The resulting effect of key shaft rotation will be to induce rotation of the inner eccentric weight 66 relative to the outer eccentric weight 68 via interaction between the axially splined portion 82 of the key shaft 70 and the splined portion 81 of the weight 66, as the splines accommodate only axial sliding.

It may now be appreciated that when the cylinder rod 102 has been fully extended (as shown in FIGS. 2 and 3), the relative positions of the weights 66, 68 will be such that the weights are out of phase (each positioned on opposite sides of the axis 40), and the vibratory mechanism 80 will thus be operating at minimum amplitude. Conversely, when the cylinder rod 102 has been fully retracted (FIG. 4), the weights will be positioned in phase (each positioned on the same side of the axis 40), and the vibratory mechanism 80 will be operating at its maximum amplitude. Of course, infinite amplitude variation will be available between the minimum and maximum amplitude positions.

In order to avoid a natural tendency for the cylinder rod 102 to rotate under axial loading under the relatively harsh vibratory conditions of compactor machines, this disclosure provides for use of a fixed guide sleeve 114 to be affixed to an adapter 110 (FIG. 4). The rotatable key shaft 70, concentrically positioned within the guide sleeve, is fixed as noted earlier to the inner race of the thrust bearing. Since the thrust bearing moves axially, the guide sleeve may be used to keep the cylinder rod 102 from turning with the key shaft. For this purpose, a guide sleeve slot 118 runs axially along the guide sleeve 114 in cooperation with a guide pin 120 that extends radially through the slot 118. The guide pin may be secured to the bearing housing 116, and adapted to move transversely with axial movement of the thrust bearing 112. As the pin is translated along the slot, the interaction between the guide pin 120 and the bearing housing 116 is such that the bearing housing is restrained against rotation. Thus, the cylinder rod, juxtaposed against the actuator end of the key shaft, will not rotate even under conditions of harsh vibration and reciprocal movement.

Figure 5:
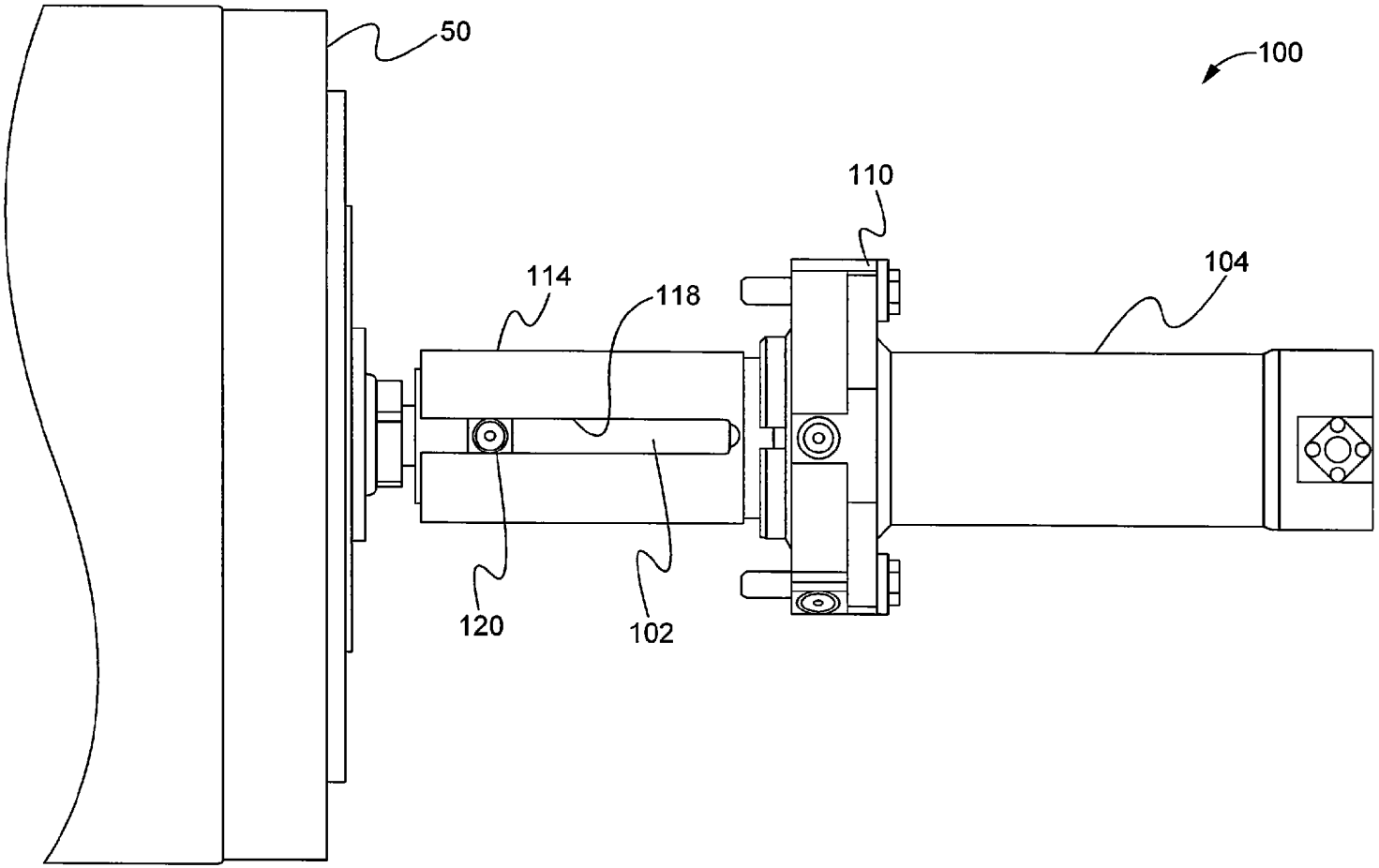
FIG. 5 is an elevational view of the guide sleeve and guide pin, with actuator cylinder rod and key shaft depicted in their fully extended positions.
Figure 6:
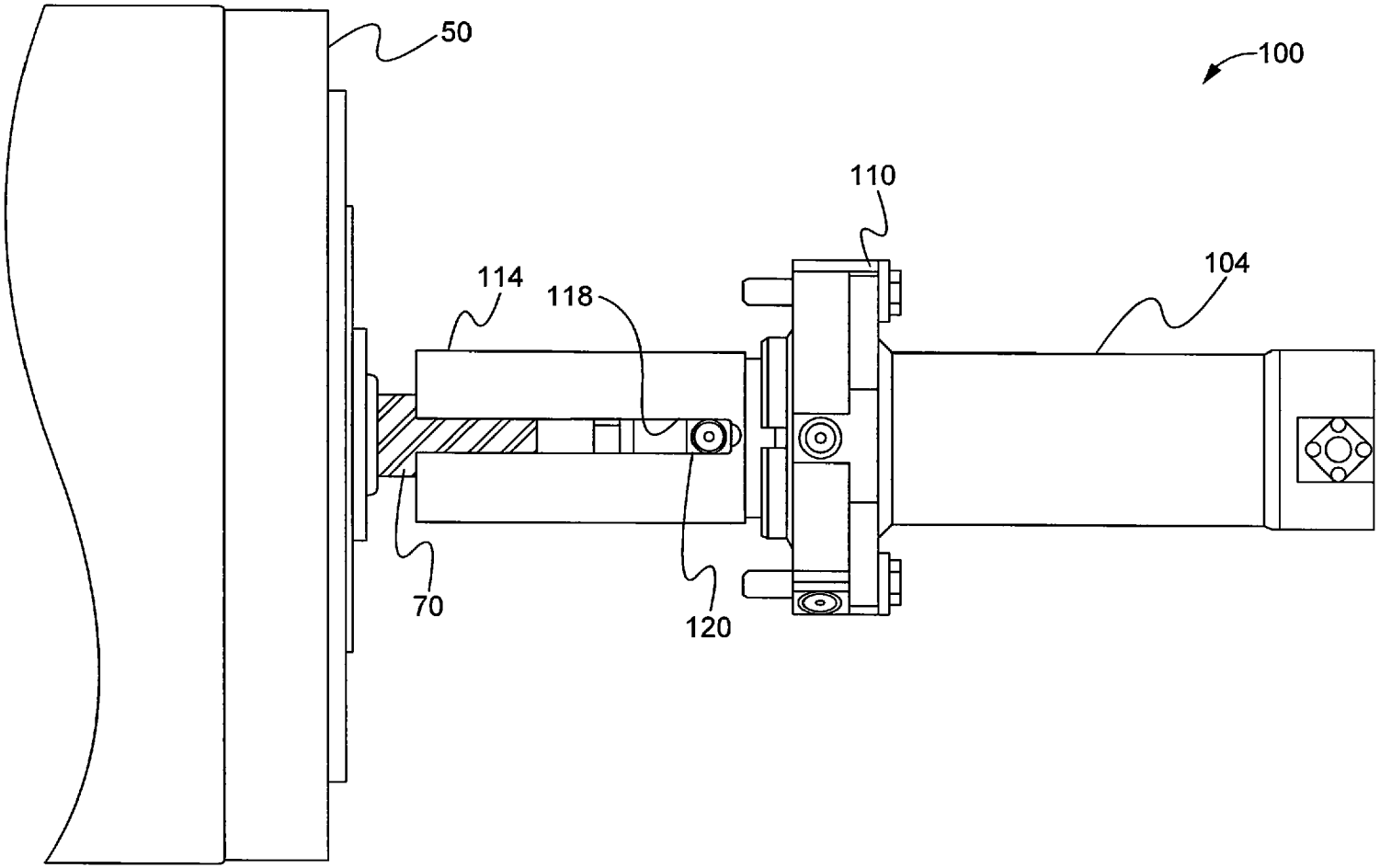
FIG. 6 is an elevational view of the guide sleeve and guide pin, with actuator cylinder rod and key shaft depicted in their fully retracted positions.

Referring now to FIGS. 5 and 6, the linear actuator 100 is depicted in fully extended and fully retracted positions, respectively. As noted earlier, the extended position, wherein the guide pin 120 is at the left end of the guide slot 118 as shown in FIG. 5, represents a position of minimum vibratory amplitude. Conversely the retracted position, wherein the guide pin 120 is at the right end of the guide slot 118 as shown in FIG. 6, represents a position of maximum vibratory amplitude.

While the foregoing contains only brief descriptions of certain modifications and alternative constructions, this disclosure is intended to cover all modifications, alternative constructions, and equivalents that may fall within its spirit and scope.

INDUSTRIAL APPLICABILITY

In general, the present disclosure addresses apparatus for preventing premature wear of linear cylinder rod and actuator parts utilized within a compactor machine. Such improved apparatus may be useful in various industrial machines, including but not limited to vibratory compactors, loaders, track-type tractors, or any other work machine used in construction, agriculture, and industrial environments.

In operation, the actuator may be employed to reciprocally move a key shaft linearly within the bore of an inner eccentric weight, positioned concentrically within an outer eccentric weight, without undesirable effects of the rotation of linear actuator parts relative to one another. As a vibratory motor of an associated compaction machine spins a pair of eccentric weights, the amplitude of compaction may be controlled by bringing the inner eccentric weight into phase or out of phase with the outer eccentric weight as earlier described. More specifically, under conditions of substantial vibration, the apparatus of this disclosure may be effective to minimize wear by arresting rotations of the described thrust bearing and cylinder rod parts that might occur during extension and retraction cycles of the cylinder rod. Such rotation may be induced by the gyrating cyclic rotary movements of the key shaft in a compactor machine.

The thrust bearing and guide sleeve arrangement disclosed may be effective to prevent cylinder rod rotation by virtue of the guide pin secured to the bearing housing through the guide sleeve slot. During extension and retraction cycles of the cylinder rod and key shaft, the rotation of the key shaft secured to, and rotatable with, the inner race of the thrust bearing will be ineffective to induce rotary movement of either the bearing or the cylinder rod by virtue of the guide pin secured to the bearing housing. Although the guide pin is free to be translated axially along the guide sleeve slot during extension and retraction of the key shaft, it is restrained against rotation by the guide sleeve slot, and thus rotation of the cylinder rod may be effectively prevented.

Finally, the described apparatus offers a method of preventing actuator cylinder rod rotation via use of a thrust bearing and guide sleeve, the guide sleeve incorporating a slot for accommodating an axially translatable guide pin affixed to the thrust bearing housing. As such, the method may provide that the key shaft is free to rotate while the cylinder rod may move linearly but is restrained against rotation.

What is claimed is:

1. An apparatus for transferring a linear load through a high-speed rotating member, the apparatus comprising:

a linear actuator including an actuator cylinder and a cylinder rod contained and axially translatable within the actuator cylinder;

a mounting adapter fixed against axial and rotary movement, the mounting adapter having the actuator cylinder affixed rigidly thereto;

an elongate guide sleeve also fixed to the mounting adapter, the guide sleeve comprising an axially extending linear slot substantially along its length, the guide sleeve adapted to accommodate passage of one end of the cylinder rod therethrough;

an axially translatable thrust bearing affixed to an end of the cylinder rod, the bearing including a housing, the housing containing an outer race fixed against rotation;

a key shaft affixed to an inner race of the bearing for rotation and axial movement therewith; and a guide pin extending radially through the slot and affixed to the housing, wherein the guide pin is adapted to move transversely along the linear slot and interacts with the slot to prevent rotation of both the housing and the cylinder rod as the cylinder rod is extended and retracted within the actuator cylinder.

2. The apparatus of claim 1, further comprising a vibratory mechanism having an inner and outer pair of eccentric weights, wherein the inner weight is positioned concentrically within the outer weight, and wherein linear movement of the key shaft is adapted to rotate the inner eccentric weight relative to the outer eccentric weight whenever the cylinder rod is extended and retracted within the actuator cylinder.

3. The apparatus of claim 2, wherein the inner eccentric weight comprises an axially splined bore, and wherein the outer eccentric weight comprises a helically splined bore; wherein the key shaft comprises an axially splined first end adapted to mate with the axially splined bore, and wherein the key shaft comprises a helically splined second end adapted to mate with the helically splined bore.

4. The apparatus of claim 3, wherein linear movement of the cylinder rod induces axial movement of the key shaft, wherein the axial movement of the key shaft results in rotary movement of the key shaft, in turn causing rotary movement of the inner eccentric weight relative to the outer eccentric weight.

5. The apparatus of claim 2, wherein extension and retraction of the cylinder rod causes the inner and outer eccentric weights to move between positions of maximum and minimum amplitude phase limits of the vibratory mechanism.

6. The apparatus of claim 3, wherein when the axially splined portion of the key shaft is moved axially within the axially splined bore of the inner eccentric weight, the helically splined portion of the key shaft interacts with the helically splined bore to induce rotation of the inner eccentric weight relative to the outer eccentric weight.

7. The apparatus of claim 1, wherein the high-speed rotating member further comprises a vibratory motor adapted to rotate the vibratory mechanism.

8. The apparatus of claim 1, wherein the outer eccentric weight is interposed between a pair of stub shafts adapted to rotate about an axis.

9. The apparatus of claim 1, wherein the guide sleeve and the actuator cylinder are affixed to opposed sides of the mounting adapter.

10. The apparatus of claim 1, wherein the linear actuator is powered by a pump.

11. A compactor machine comprising a vibratory mechanism having an inner and outer pair of eccentric weights, wherein the inner weight is positioned concentrically within the outer weight; the compactor machine further comprising apparatus for moving the weights rotationally relative to each other, the apparatus comprising:

a linear actuator including an actuator cylinder and a cylinder rod contained and axially translatable within the actuator cylinder;

a mounting adapter fixed against axial and rotary movement, the mounting adapter having the actuator cylinder affixed rigidly thereto;

an elongate guide sleeve also fixed to the mounting adapter, the guide sleeve comprising an axially extending linear slot substantially along its length, the guide sleeve adapted to accommodate passage of an end of the cylinder rod therethrough;

an axially translatable thrust bearing affixed to the end of the cylinder rod, the bearing including a housing, the housing containing an outer race fixed against rotation;

a key shaft affixed to an inner race of the bearing for rotation and axial movement therewith; and a guide pin extending radially through the slot and affixed to the housing, wherein the guide pin is adapted to move transversely along the linear slot and interacts with the slot to prevent rotation of both the housing and the cylinder rod as the cylinder rod is extended and retracted within the actuator cylinder.

12. The compactor machine of claim 11 wherein linear movement of the key shaft is adapted to rotate the inner eccentric weight relative to the outer eccentric weight whenever the cylinder rod is extended and retracted within the actuator cylinder.

13. The compactor machine of claim 12 wherein the inner eccentric weight comprises an axially splined bore, and wherein the outer eccentric weight comprises a helically splined bore; wherein the key shaft comprises an axially splined first end adapted to mate with the axially splined bore, and wherein the key shaft comprises a helically splined second end adapted to mate with the helically splined bore.

14. The compactor machine of claim 13, wherein linear movement of the cylinder rod induces axial movement of the key shaft, wherein the axial movement of the key shaft results in rotary movement of the key shaft, in turn causing rotary movement of the inner eccentric weight relative to the outer eccentric weight.

15. The compactor machine of claim 12, wherein extension and retraction of the cylinder rod causes the inner and outer eccentric weights to move between positions of maximum and minimum amplitude phase limits of the vibratory mechanism.

16. The compactor machine of claim 13, wherein when the axially splined portion of the key shaft is moved axially within the axially splined bore of the inner eccentric weight, the helically splined portion of the key shaft interacts with the helically splined bore to induce rotation of the inner eccentric weight relative to the outer eccentric weight.

17. The compactor machine of claim 11 wherein a high-speed rotating member further comprises a vibratory motor adapted to rotate the vibratory mechanism.

18. The compactor machine of claim 11 wherein the outer eccentric weight is interposed between a pair of stub shafts adapted to rotate about an axis.

19. The compactor machine of claim 11 wherein the guide sleeve and the actuator cylinder are affixed to opposed sides of the mounting adapter.

20. A method of transferring a linear load through a high-speed rotating member, comprising:

providing a linear actuator, including an actuator cylinder and a cylinder rod contained and axially translatable within the actuator cylinder;

providing a mounting adapter fixed against axial and rotary movement, the mounting adapter having the actuator cylinder affixed rigidly thereto;

providing an elongate guide sleeve also fixed to the mounting adapter, the guide sleeve including an axially extending linear slot substantially along its length, the guide sleeve being adapted to accommodate passage of one end of the cylinder rod therethrough;

providing an axially translatable thrust bearing affixed to the one end of the cylinder rod, the bearing having a housing containing an outer race fixed against rotation, the housing having an inner race adapted for relative rotation;

providing a key shaft affixed to the inner race of the bearing for rotation and axial movement therewith; and providing a guide pin extending radially through the linear slot and affixed to the housing, the guide pin being adapted to move transversely along the linear slot and interacting with the linear slot to prevent rotation of both the housing and the cylinder rod as the cylinder rod is extended and retracted within the actuator cylinder.

* * * * *